United States Patent [19]

Brasch

[11] 4,221,211

[45] Sep. 9, 1980

[54] INFANT ELEVATOR FOR USE WITH AN INCUBATOR

[75] Inventor: Robert C. Brasch, Mill Valley, Calif.

[73] Assignee: The Regents of the University of California, Berkeley, Calif.

[21] Appl. No.: 12,140

[22] Filed: Feb. 14, 1979

[51] Int. Cl.[3] ..... A61G 11/00

[52] U.S. Cl. ..... 128/1 B; 5/81 R; 187/9 E; 128/205.26

[58] Field of Search ..... 128/1 B, 1 R, 204, 205.26, 128/30, 30.2; 5/81 R, 86; 269/7 R, 7 B, 17; 187/9 E; 119/37, 39

[56] References Cited

U.S. PATENT DOCUMENTS

| | | | |
|---|---|---|---|
| 3,858,570 | 1/1975 | Beld et al. | 128/1 B |
| 3,876,039 | 4/1975 | Bushnell, Jr. | 187/9 E |
| 3,917,076 | 11/1975 | Campbell | 5/86 X |

FOREIGN PATENT DOCUMENTS 2321913 11/1974 Fed. Rep. of Germany .

*Primary Examiner*—Henry J. Recla
*Attorney, Agent, or Firm*—Lothrop & West

[57] ABSTRACT

An infant incubator includes a table with an enclosing hood movably overlying the table. To work with the incubator, an exterior elevator can be clamped in position relative to the table and has a plunger movable vertically relative to the table. There are lifting arms on the plunger adapted to extend through slots in the hood and into engagement with arm-engaging means on an infant tray adapted to rest on the table beneath the hood. The tray preferably has an x-ray transparent bottom area and is movable by the lifting arms into various positions above an x-ray cassette on the table beneath the bottom area. Tubes and connectors can be fastened to the tray so as to move therewith as the elevator plunger operates the tray.

6 Claims, 4 Drawing Figures

INFANT ELEVATOR FOR USE WITH AN INCUBATOR

BRIEF SUMMARY OF THE INVENTION

To assist in the radiography of sick, newborn infants it is important to position the infant with respect to the x-ray plates or films in a particular fashion and at a particular, selected distance. This is advisable to get as clear an exposure, and preferably as magnified an exposure, as possible. A difficulty is that the infant should be handled and disturbed just as little as possible, yet must have his relationship to the x-ray film or plate controlled and arranged as precisely as possible. This is accomplished by maintaining the infant in an incubator or comparable enclosure in accordance with the preferred general practice and then providing a tray for use within the incubator. The tray supports the infant above a bottom area of the tray transparent to x-rays and is movable by means of an elevator to the desired or selected distance above an x-ray film or plate on or below the bottom of the tray beneath the x-ray transparent area. Also, the tray is preferably provided with means for engaging various life-supporting and monitoring tubes or connectors and holding them stationary with respect to the infant. The tray can nevertheless be moved within the incubator while the infant thereon remains connected, without disturbance, to his life-sustaining and observational attachments.

DETAILED DESCRIPTION

There are numerous problems in deriving x-ray showings from sick, newborn infants, yet such technology is highly valuable in assisting in saving infant lives. It is customary to house such an infant on a table within an enclosure having a controlled atmosphere, such a device often being referred to as an incubator. When in the incubator, the infant is often connected by tubes, wires and other connectors with various life-supporting or factor-recording devices outside of the incubator and is generally under observation in a highly controlled environment. If, then, x-ray pictures are required of the infant so situated, a number of problems arise, not only with respect to the desirability of disturbing the infant as little as possible, but also in arranging matters geometrically so that usable x-ray prints or plates can be obtained.

Pursuant to the present invention, some relatively standard mechanisms are particularly adapted, combined and improved to provide a facility which permits taking of x-rays under normally adverse conditions but with very little or no disturbance of the infant and yet with quite usable results.

Figure 1:
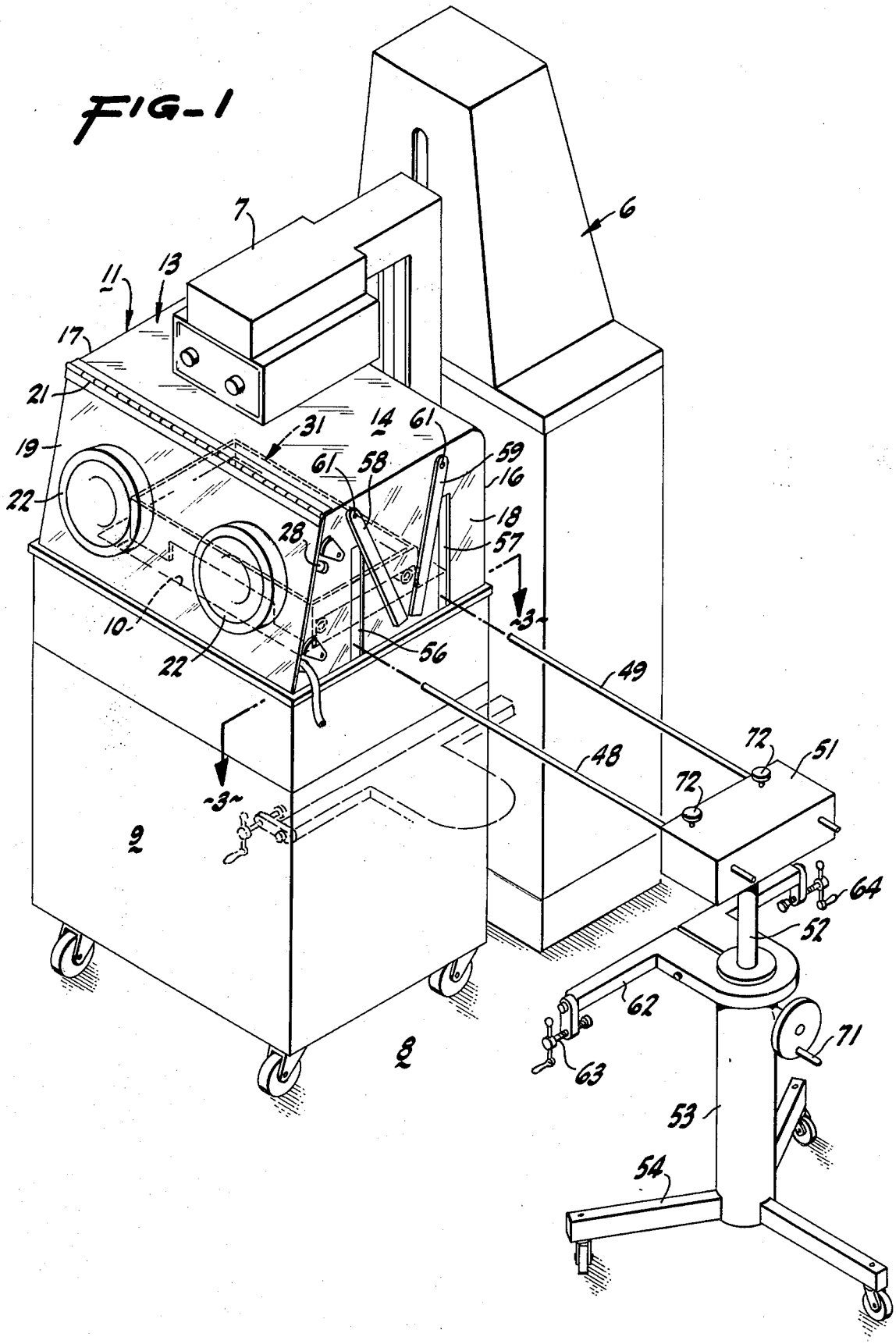
FIG. 1 is an isometric view showing an infant elevator arrangement in connection with a cooperating incubator mechanism positioned in the vicinity of an x-ray device, some of the portions being shown in their positions between x-ray exposures.
Figure 2:
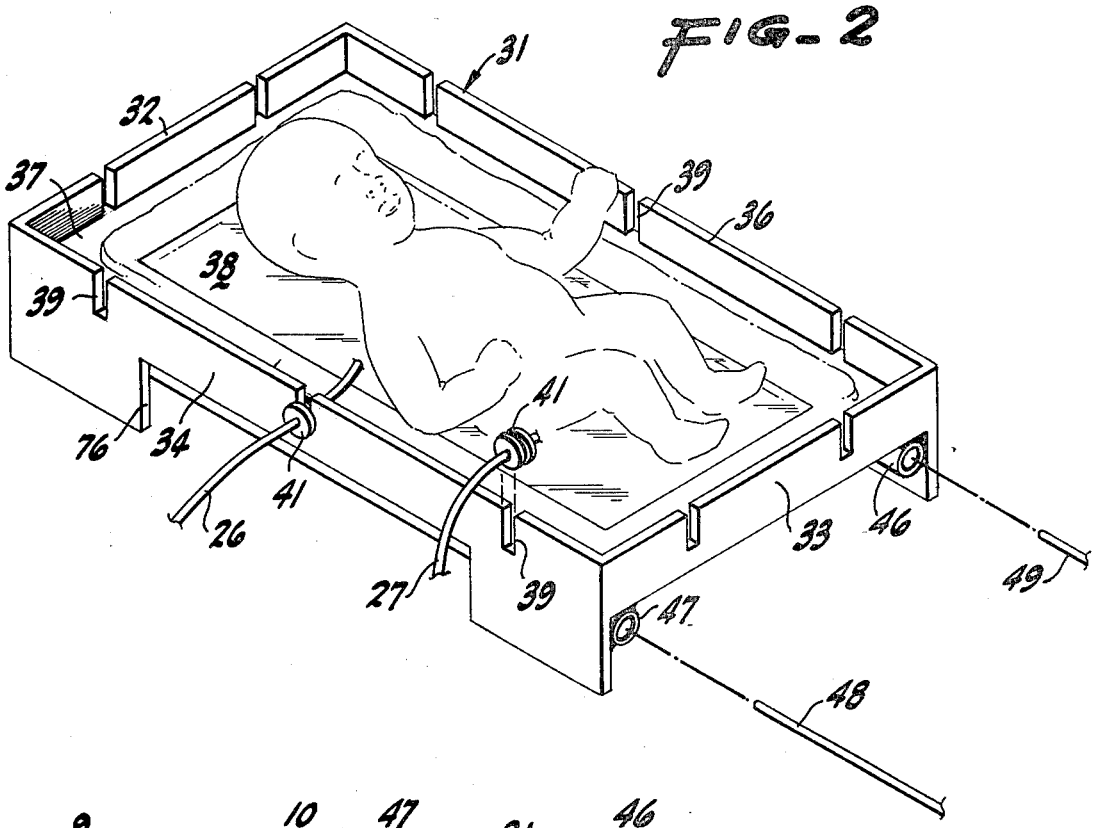
FIG. 2 is an isometric view of an infant in an infant tray of the sort utilized in connection with the structure of FIG. 1, certain portions of the attendant mechanisms being omitted for clarity and other portions being broken away to reduce the size of the figure.
Figure 3:
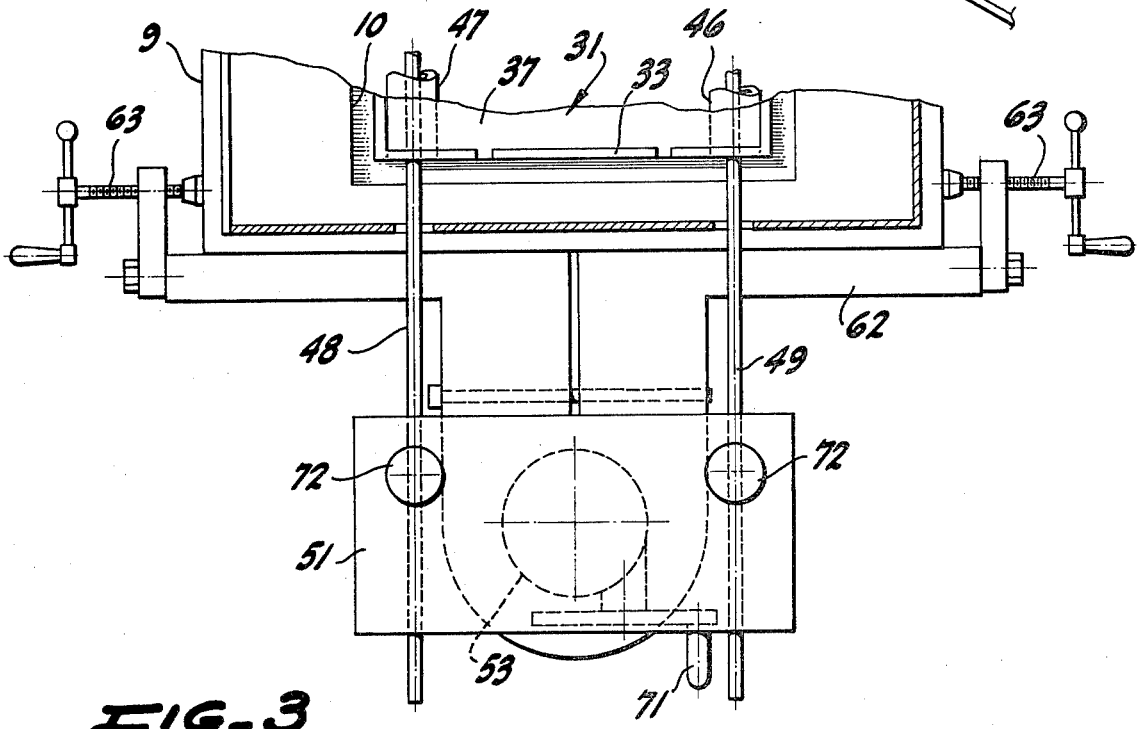
FIG. 3 is a fragmentary cross-section, the plane of which is indicated by the line 3—3 of FIG. 1.
Figure 4:
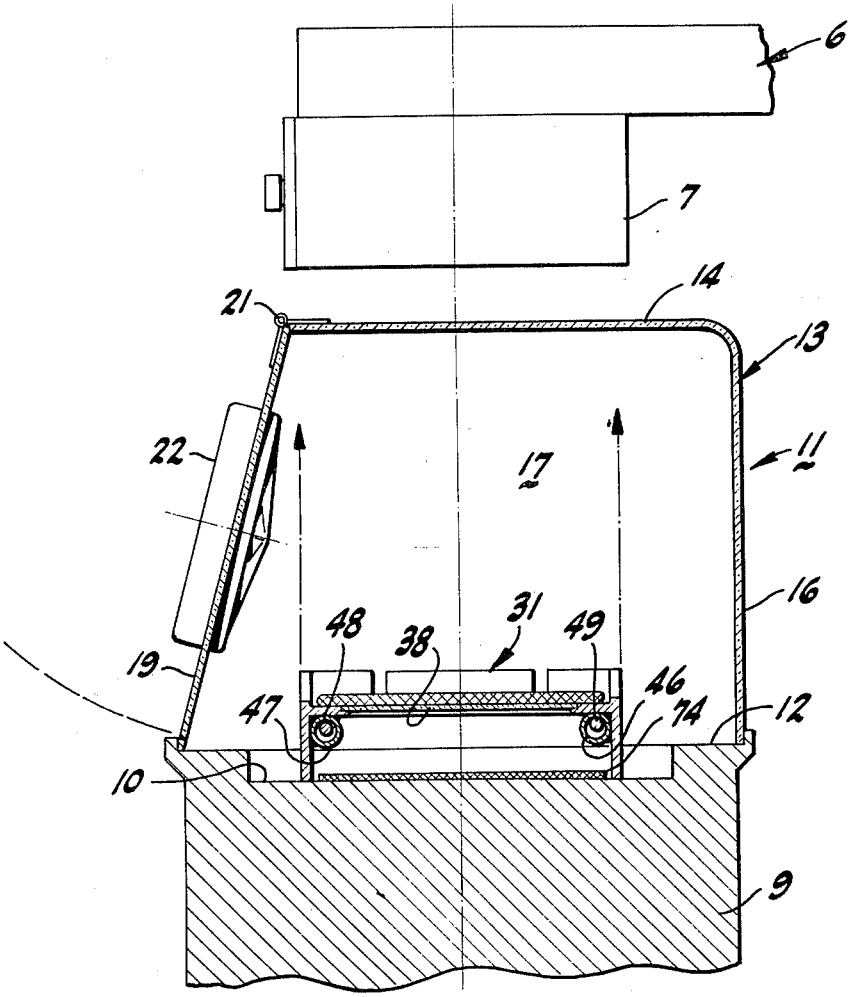
FIG. 4 is a cross-section on a vertical plane transversely through the incubator showing the construction of the tray and the position of the x-ray cassette.

In a typical environment, there is afforded an x-ray machine 6 of any standard kind which has an effective picture-taking head 7 disposed at an appropriate elevation above the floor 8. Resting on the floor is a cabinet 9 forming part of an incubator, generally designated 11, and inclusive of a supporting table 12 (FIG. 4) arranged at an appropriate and convenient height above the floor 8. The table may, if desired, have a depressed, central panel 10. The space above the table 12 is enclosed almost entirely by a hood 13 preferably of transparent material. The hood is inclusive of a top panel 14 disposed just below the x-ray head 7, a rear panel 16 designed to clear the x-ray machine 6 and particularly the head 7 thereof, a pair of end panels 17 and 18, and a front panel 19 conveniently connected to the top panel 14 by a longitudinal hinge 21.

The front panel can be swung up and swung down to afford access to the interior of the incubator or to be closed generally to isolate the interior of the incubator. It is customary to provide hand openings 22 in the panel 19. The interior of the incubator is connected to suitable atmospheric regulating structures, the details of which are not important herein. The atmosphere within the incubator is maintained at selected temperatures, humidities and air flow velocities in accordance with the requirements of the attending physician.

In many instances the infant is put onto the table 12 on a relatively thin, x-ray transparent mattress or comparable support and very often the infant is connected by tubes 26 or wires 27 or the like to exterior instrumentalities. These leads, such as 26 and 27, are taken from the exterior into the interior of the incubator, preferably through notches 28 provided at intervals around the edges of the end panels thereof, the notches being relatively small and thus not interfering particularly with the interior ventilation of the structure.

In accordance with the present invention, the mattress within the incubator may be dispensed with and can be replaced by or can be used with an infant tray 31 that is readily received within the incubator hood and occupies much of the area of the table 12 thereof. The tray conveniently is a one-piece molding of an x-ray transparent, plastic material. It has its own end walls 32 and 33 joining its own side walls 34 and 36 and has its own bottom wall 37 or floor. In this instance, the floor 37 is not completely integral, but rather has a relatively large, central, rectangular portion given over to an x-ray transparent, thin plate 38 of "Lexan" or other comparable light polycarbonate.

In addition, the tray side walls, at least some of them, are preferably provided with interruptions in the form of notches 39 in position for conveniently receiving conductors such as the wires and tubes 26 and 27. These can be temporarily anchored therein against endwise or sidewise movement by grommets 41 or by adhesive tape. While the portions of the conductors 26 and 27 outside of the tray can easily be moved and can be extended in any desired fashion through the interior of the incubator to extend therefrom through the notches 28, nevertheless there is no substantial movement of any such conductor on the inside of the tray and adjacent or relative to the infant.

The tray also includes a pair of parallel tubes 46 and 47 extending generally longitudinally thereof but outside the area of the window 38 and effective as to their position and arrangement readily to receive a pair of lift rods 48 and 49. These extend parallel to each other from an elevator head 51 at the upper end of an elevator plunger 52 vertically reciprocable in an elevator housing 53 having a spider support 54 on the floor 8.

Since the rods 48 and 49 are not always to be engaged with the tubes 46 and 47, but since they must be able to move vertically with respect to the housing 11, certain provisions are made. Preferably the end wall 18 is provided with a pair of vertical slots 56 and 57 extending from the table 12 upwardly very nearly to the top panel 14 of the hood 13. The slots are of adequate dimension easily to receive and pass the rods 48 and 49, and even to allow a little leeway for lateral displacement. In order to preclude the slots interfering with the air conditioning within the hood 13, there are provided covers 58 and 59 secured to the upper portion of the end wall 18 by swinging fasteners 61. The covers normally hang by gravity over the slots 56 and 57 and close them, but readily can be displaced laterally when the rods 48 and 49 are to be positioned therethrough.

In many instances, the incubator 11 and the elevator 53 are sufficiently stable so that they need not be especially interrelated, but under other circumstances and depending on some of the other surroundings, it is advisable in many cases to augment the elevator. There is then provided around the upright 53 a frame 62 of substantially the width of the housing 9 and having facing screw clamps 63 and 64 freely mounted thereon. With this arrangement, the elevator can be clamped to the incubator so that there is no possibility of relative dislodgment between them.

In a typical use of this structure, an infant is placed on the "Lexan" floor portion 38 either directly or on a relatively thin, x-ray transparent, small blanket. The infant is provided with the necessary and customary connectors and tubes 26 and 27. These are engaged with the side walls of the tray 31 either by means of the grommets 41 or by means of adhesive tape straps, so that there is no relative movement between the tubes 26 and 27 and the infant on the inside of the tray, although there is such movement possible on the outside of the tray. The tubes and wires then extend through the openings 28 in the side walls of the incubator to the appropriate external equipment to which they pertain.

When an x-ray exposure is to be made, the elevator 53 is wheeled into the vicinity of the incubator and an actuating handle 71 on the elevator upright is operated to bring the height of the rods 48 and 49 substantially level with the position of the tubes 46 and 47 on the tray. The elevator is shifted laterally until the rods and tubes line up. If desired, the rods 48 and 49 can be advanced or retracted and then fastened in place by thumb wheels 72 in order to adapt the elevator mechanism to the particular tray and incubator being encountered. Thereupon the elevator is moved toward the incubator with the rods 48 and 49 passing through the slots 56 and 57, the closure plates 58 and 59 being moved aside for that purpose. The rods 48 and 49 are further advanced into the tubes 46 and 47 for substantially the full length of the tray.

When the elevator has been advanced to that extent, the clamps 63 and 64 are then engaged with the sides of the incubator support cabinet 9 and are tightened so that the incubator and elevator are locked together temporarily. Thereupon, the actuating handle 71 for the elevator is again actuated in a slow, deliberate fashion and then is effective to lift the tray 31 with the infant on it away from the table 12 up toward the x-ray head 7 near the top of the hood 13. At a convenient height, x-ray pictures are taken utilizing an x-ray cassette 74 which has previously been placed on the table 12 beneath the tray and the infant. Such plate positioning is facilitated by cutouts 76 in the side walls of the tray. The elevator can be moved up and down without in any fashion disturbing the connectors 26 and 27 so far as the infant is concerned.

When the x-ray pictures have been taken, the clamps 63 and 64 are released, the elevator 53 is lowered to the bottom and is withdrawn or is moved away from the incubator as the rods 48 and 49 are extracted from the tubes 46 and 47. The cover plates 58 and 59 fall by gravity into position over the slots 56 and 57, so that the infant within the incubator is again enclosed. It has been found in actual practice that it is possible to get good x-ray photographs of sick, young infants without adversely disturbing them in any fashion.

What is claimed is:

1. An infant elevator in combination with an incubator comprising means providing a supporting table, a hood supported on said table and with said table providing an infant enclosure, an infant tray adapted to rest on said table within said hood, lift arm engaging means on said tray in predetermined positions, means in said hood defining openings in alignment with said predetermined positions, an elevator including a plunger means adapted to move vertically alongside of and relative to said table, and lifting arms on said plunger means movable through said openings into and out of physical supporting engagement with said engaging means.

2. A device as in claim 1 including means for releasably engaging said elevator and said supporting table.

3. A device as in claim 1 in which said openings are vertical slots.

4. A device as in claim 1 including means for removably covering said openings.

5. A device as in claim 1 including an x-ray transparent bottom in said tray between said lift arm engaging means.

6. A device as in claim 1 including means on said tray engageable with a tube within said hood and adjacent the edge of said tray for holding said tube stationary relative to said tray in all elevated positions of said tray within said hood.

* * * * *